US006327747B1

(12) United States Patent
Stahlecker

(10) Patent No.: US 6,327,747 B1
(45) Date of Patent: Dec. 11, 2001

(54) PROCESS AND APPARATUS FOR CONDENSING A DRAFTED FIBER STRAND

(75) Inventor: Gerd Stahlecker, Eislingen/Fils (DE)

(73) Assignees: Fritz Stahlecker, Bad Überkingen; Hans Stahlecker, Süssen, both of (DE)

( * ) Notice: Subject to any disclaimer, the term of this patent is extended or adjusted under 35 U.S.C. 154(b) by 0 days.

(21) Appl. No.: 09/574,205

(22) Filed: May 19, 2000

(30) Foreign Application Priority Data

May 19, 1999 (DE) ..... 199 22 861

(51) Int. Cl.[7] ..... D01H 5/86
(52) U.S. Cl. ..... 19/246; 19/150; 57/315
(58) Field of Search ..... 19/150, 236–250, 19/252, 263, 286–288, 304–308; 57/264, 304, 315, 328, 333

(56) References Cited

U.S. PATENT DOCUMENTS 3,131,438 * 5/1964 Klein ..... 19/288
4,953,349 * 9/1990 Fehrer ..... 19/288
5,285,624 * 2/1994 Stahlecker ..... 57/328
5,431,005 * 7/1995 Fehrer ..... 57/315
5,600,872 2/1997 Artzt et al. .....
6,131,383 * 10/2000 Dinkelmann et al. ..... 57/315

FOREIGN PATENT DOCUMENTS 19722528 9/1998 (DE) .....

* cited by examiner

*Primary Examiner*—John J. Calvert
*Assistant Examiner*—Gary L. Welch
(74) *Attorney, Agent, or Firm*—Crowell & Moring LLP

(57) ABSTRACT

In a process for condensing a drafted fiber strand in a condensing zone arranged downstream of a front roller pair of a drafting apparatus, the fiber strand is transported through the condensing zone by means of a perforated, suctioned transport belt. It is hereby provided that the fiber strand has the same direction of motion as the transport belt. Furthermore, it is ensured that a sufficient amount of the fibers located in the fiber strand are still nipped by the front roller pair during condensing. This results in the advantage that the front ends of the fibers of the fiber strand to be condensed do not insert themselves into the perforation of the transport belt, thus leading to clogging.

28 Claims, 2 Drawing Sheets

PROCESS AND APPARATUS FOR CONDENSING A DRAFTED FIBER STRAND

BACKGROUND AND SUMMARY OF THE INVENTION

This application claims the priority of German application 199 22 861.2, filed in Germany on May 19, 1999, the disclosure of which is expressly incorporated by reference herein.

The present invention relates to a process for condensing a drafted fiber strand in a condensing zone arranged downstream of a front roller pair of a drafting apparatus, in which process the fiber strand is transported through the condensing zone by means of a perforated, suctioned transport means.

The present invention relates further to an apparatus for condensing a drafted fiber strand in a condensing zone arranged downstream of a front roller pair of a drafting unit, said apparatus comprising a stationary sliding surface, which has a suction slit extending essentially in the direction of the motion of the fiber strand, a perforated transport belt located between the fiber strand and the sliding surface, which transport belt transports the fiber strand over the sliding surface, the speed of said transport belt corresponding to at least the peripheral speed of the front roller pair, and a nipping roller bordering the condensing zone on its exit side.

A process and an apparatus of this type is prior art in U.S. Pat. No. 5,600,872. The condensing zone is bordered on its entry side as well as on its exit side by a nipping point, namely on the entry side by the nipping point of the front roller pair and on its exit side by a nipping point defined by the nipping roller, whereby the nipping roller presses against a driven bottom roller. The distance between the two nipping points is given in the known publication as 1.5 times that of the fiber length. A light tension draft is provided in the condensing zone, that is the nipping roller has a somewhat higher circumferential speed than the front roller pair. On reaching the condensing zone, the direction of motion of the fiber strand differs from the direction of motion of the transport belt.

A similar apparatus is prior art in German published patent application 197 22 528. According to this publication, the suction zone of the condensing zone is limited to between 10 and 25 mm, in order that, in the case of reduced suction performance, an improved condensing effect is attained. However, the distance between the nipping points is significantly larger than the suction zone and also larger than the fiber length. In the case of the latter publication, the matter of the airways of the transport belt becoming clogged with time is addressed. As a remedy, the suggestion is made to design the perforations of the transport belt as edge-free.

In the case of the known apparatus there is the risk that despite everything, fiber fly and trash can collect between the stationary sliding surface and the moving supporting surface of the transport belt. This trash build-up comes about, for example, in that individual fibers of the fiber strand to be condensed, in particular the shorter fibers, can insert themselves inwards with their front ends in the area of the suction slit in through the perforations of the transport belt. These fibers project then partly into the suction slit, namely until the suction slit has been passed. In the most favorable case, the relevant fiber can be cut off at the end of the suction slit and the cut-off end is suctioned off. In the least favorable case, the fiber end is simply turned over, so that it is not suctioned off, but rather is transported further with the transport belt, thus lying partly between the supporting surface and the sliding surface. This fiber can tear at any time, and can settle, in the form of dust, anywhere on the supporting surface or on the sliding surface, in particular in the case of sticky fibers containing honeydew. This results in time in varying condensing effects from spinning station to spinning station, so that at the exit side nipping points, varyingly condensed fiber strands are delivered.

The condensing of a drafted fiber strand, namely in an area to which the spinning twist is not yet retroactive, serves the purpose of bundling the fiber strand in its cross section and to make it less hairy overall. This results, after the spinning twist has been imparted, in a smoother yarn with a higher tear resistance. When, however, the desired condensing effect does not occur at even one spinning station due to an impaired condensing zone, a so-called Moiré effect occurs in the later fabric, which can render it a reject product. It must be ensured, therefore, that the condensing effect at the individual condensing zones of the spinning stations is constantly maintained.

It is an object of the present invention to ensure that the perforations of the transport belt do not become clogged, and that in the area between the supporting surface of the transport belt and the stationary sliding surface no small deposits can form.

This object has been achieved in the process in accordance with the present invention in that the fiber strand has the same direction of motion as the transporting means when it reaches the condensing zone, and in that a sufficient amount of fibers located in the fiber strand continues to be nipped by the front roller pair during condensing.

The transport means has thus in the case of long fibers in the condensing zone—in the same direction—the same or a greater speed than the front ends of the fibers, which thus cannot insert themselves in the first place into the perforations of the transporting means. In the case of short fibers, however, it is sufficient when as high a percentage as possible of fibers are still controlled by the front roller pair as soon as the front ends are seized by the suction.

This object has been achieved in relation to the apparatus in accordance with the present invention in that the distance between the nipping points defined by the front roller pair on the one side and by the nipping roller on the other side is, in any case, not very much greater than the average staple length of the fibers located in the fiber strand.

This reliably prevents the fibers in the condensing zone from being seized by the suction force at their fronts ends and crawling forwards on the transport belt. The suction of the front end of the fibers into the perforations is thus effectively prevented.

In the case of short stapled material to be spun, the distance between the nipping points measures advantageously between 20 and 27 mm. The smaller value is selected for synthetic fiber material, in particular for viscose fibers.

In an embodiment of the present invention, the suction slit arranged directed against the transport belt has a shaft-like opening. Experience has shown that in the case of such openings of suction tubes in general, almost no fibers collect there. The shaft-like opening may taper in suction direction, which results in an acceleration of the suctioned fibers. In contrast, in the case of a suction slit in a metal sheet, in which the height of the suction slit corresponds to the thickness of the metal sheet, the risk of clogging, caused by increased turbulences, would arise.

The shaft-like opening is formed for the purpose by an exchangeable fitted window. The suction slit can then be adapted easily to various fiber materials.

In a further embodiment of the present invention, the front roller pair can have a bottom roller which is provided on its periphery with a profiling, which is disposed with a light pressure on the transport belt outside of the condensing zone.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
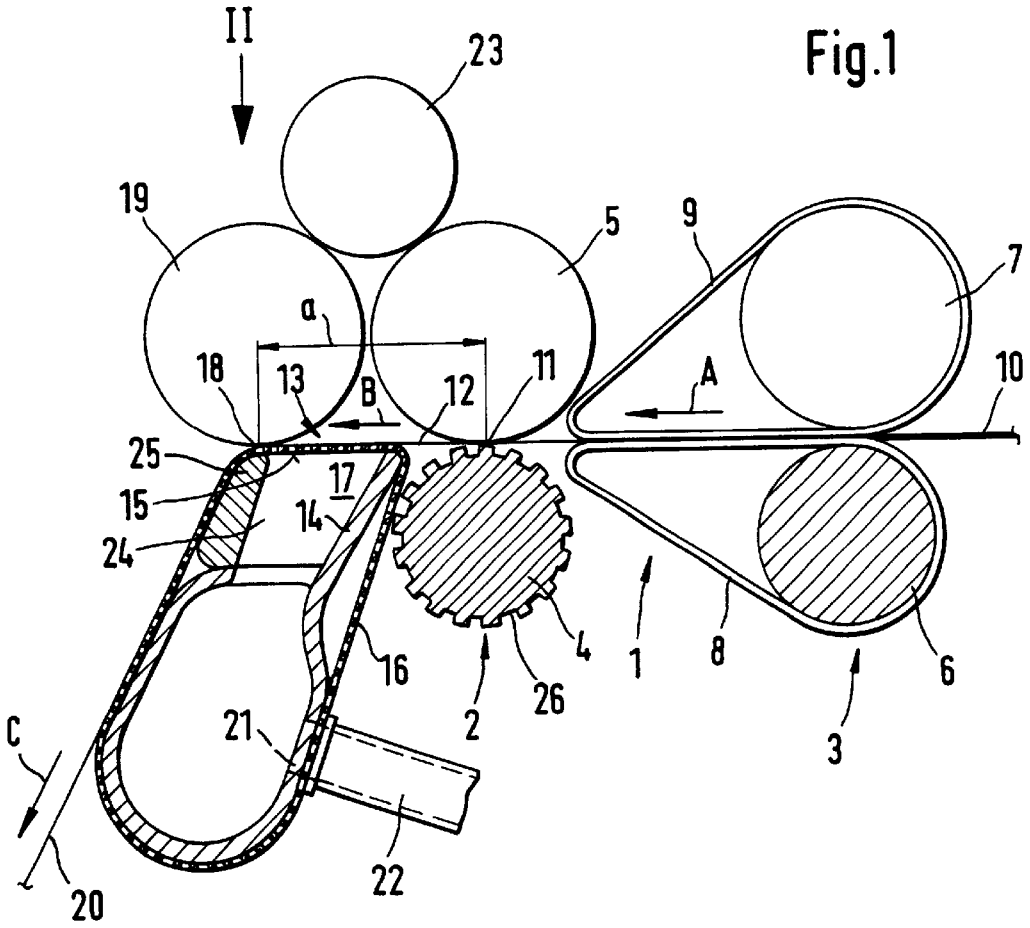
FIG. 1 is a part sectional side view of an arrangement according to a preferred embodiment of the present invention.
Figure 2:
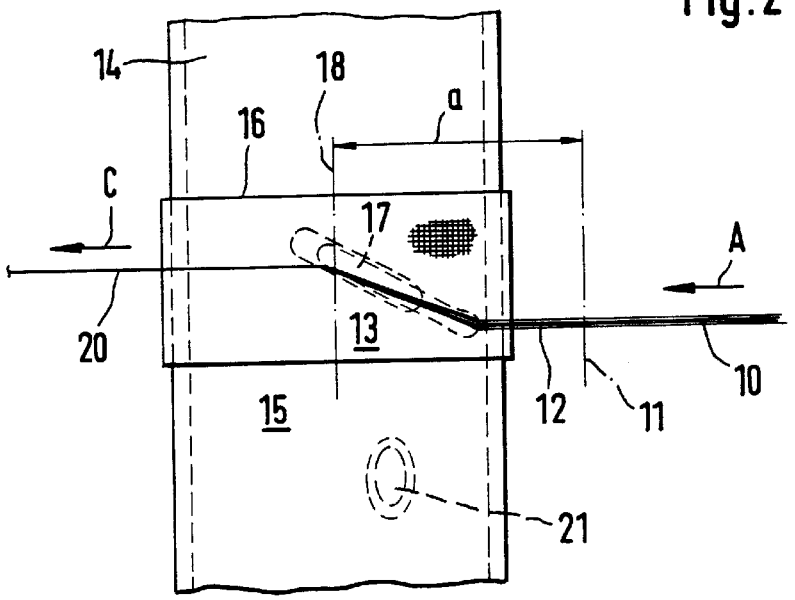
FIG. 2 is a view in the direction of the arrow II of FIG. 1 onto the condensing zone.

Of the drafting apparatus 1 of a spinning station of a ring spinning machine, only the front roller pair 2 and the apron roller pair 3 arranged upstream thereof are shown in FIGS. 1 and 2. The front roller pair 2 comprises a driven bottom roller 4, which extends over a plurality of spinning stations, and also comprises a pressure roller 5 arranged at each spinning station. In a similar way, the apron roller pair 3 comprises a driven bottom roller 6, and also a pressure roller 7 per spinning station. In addition, a bottom apron 8 and an upper apron 9 can be seen.

In the drafting apparatus 1, a sliver or a roving 10 is transported in transport direction A in a known way and is drafted to the desired degree of fineness. Directly downstream of the nipping point 11 of the front roller pair 2, a drafted, but still twist-free fiber strand 12 is present.

A condensing zone 13 is arranged downstream of the drafting apparatus 1, said condensing zone 13 comprising a device for condensing the fiber strand 12. This device comprises a hollow section 14, which extends over a plurality of spinning stations. The outer contour of the hollow section 14 comprises a stationary sliding surface 15, to which a transporting means in the form of a transporting belt is arranged at each spinning station.

The transport belt 16 belonging to the condensing zone 13 is designed in an air-permeable way, and consists preferably of a fine-pored woven fabric of polyamide threads. The transport belt 16 transports the fiber strand 12 to be condensed through the condensing zone 13 and over a suction slit 17 of the sliding surface 15. The suction slit 17 is somewhat wider than the condensed fiber strand 12 and is arranged at a slight slant in direction of motion B of the fiber strand 12, so that the fiber strand 12 is imparted a light false twist during condensing. The suction slit 17 extends to a nipping point 18, which is formed between a nipping roller 19 and the sliding surface 15 of the hollow section 14, and which borders the condensing zone 13 on its exit side. The nipping roller 19 presses the fiber strand 12 and the transport belt 16 against the sliding surface 15.

Downstream of the nipping point 18, a yarn or thread 20 is present to which the spinning twist is imparted. The nipping roller 19 serves as a twist block for the spinning twist, so that the fiber strand 12 is twist-free in the condensing zone 13. Downstream of the nipping point 18, the thread 20 is fed in delivery direction C to a ring spindle (not shown).

The hollow section 14 comprises per machine section an opening 21, which is connected with a vacuum source (not shown) by means of a suction tube 22. Thus a suction effect acts through the perforated transport belt 16 onto the fiber strand 12 to be condensed.

The nipping roller 19 is connected to a drive, which is derived by means of a transfer roller 23 from the pressure roller 5 of the front roller pair 2. The peripheral speed of the nipping roller 19 is slightly greater than the peripheral speed of the front roller pair 2.

The transport belt 16 is provided on its side facing away from the fiber strand 12 with a bearing surface, which slides on the stationary sliding surface 15. There is a risk here that fiber fly and trash will settle between the bearing surface and the sliding surface 15. The front ends of individual fibers, in particular the shorter fibers, can namely project through the perforations of the transport belt 16 into the suction slit 17. When such fibers turn over at the end of the suction slit 17, that is when they are leaving the condensing zone 13, they then reach the area between the beading surface of the transport belt 16 and the stationary sliding surface 15. This leads after a time to an impairment of the condensing effect of the respective condensing zone 13.

In order to avoid this disadvantage it is provided that when the fiber strand 12 reaches the condensing zone 13, it takes the same direction of motion B as the transport belt 16. Thus the front ends of the fibers cannot reach the area of the perforations in the first place. In addition it is provided that most of the fibers located in the fiber strand 12 continue to be nipped by the front roller pair 2 during condensing. The front roller pair 2 thus controls the speed of the fiber strand 12 when it reaches the condensing zone 13 and holds the fiber strand 12 back somewhat, while the transport belt 16 runs at a slightly higher speed. These measures also prevent the front ends of the fibers from inserting themselves into the perforations of the transport belt 16.

The distance a between the two nipping points 11 and 18 is so selected that it is at most insignificantly larger, but preferably smaller, than the average staple length of the fibers located in the fiber strand 12. Thus the fibers leaving the nipping point 11 are prevented from crawling forward on the transport belt 16 under the effect of the suction action and thus from entering the perforations.

The suction slit 17 aligned against the transport belt 16 comprises a shaft-like opening 24, which tapers slightly in suction direction. Experience has shown that such openings 24 in general are not clogged by fiber fly. It is provided that in the area of the suction slit 17 a window 25 is fitted on the hollow section 14, so that the condensing zone 13 can, if required, be adapted to the fiber material to be spun.

The bottom roller 4 is provided on its periphery with a profiling 26, which is disposed with light pressure on the transport belt 16. Thus the bottom roller 4 serves to a certain extent as a cleaning roller, which continuously cleans the transport belt 16 of any adhering fiber fly outside of the area of the condensing zone 13.

Figure 3:
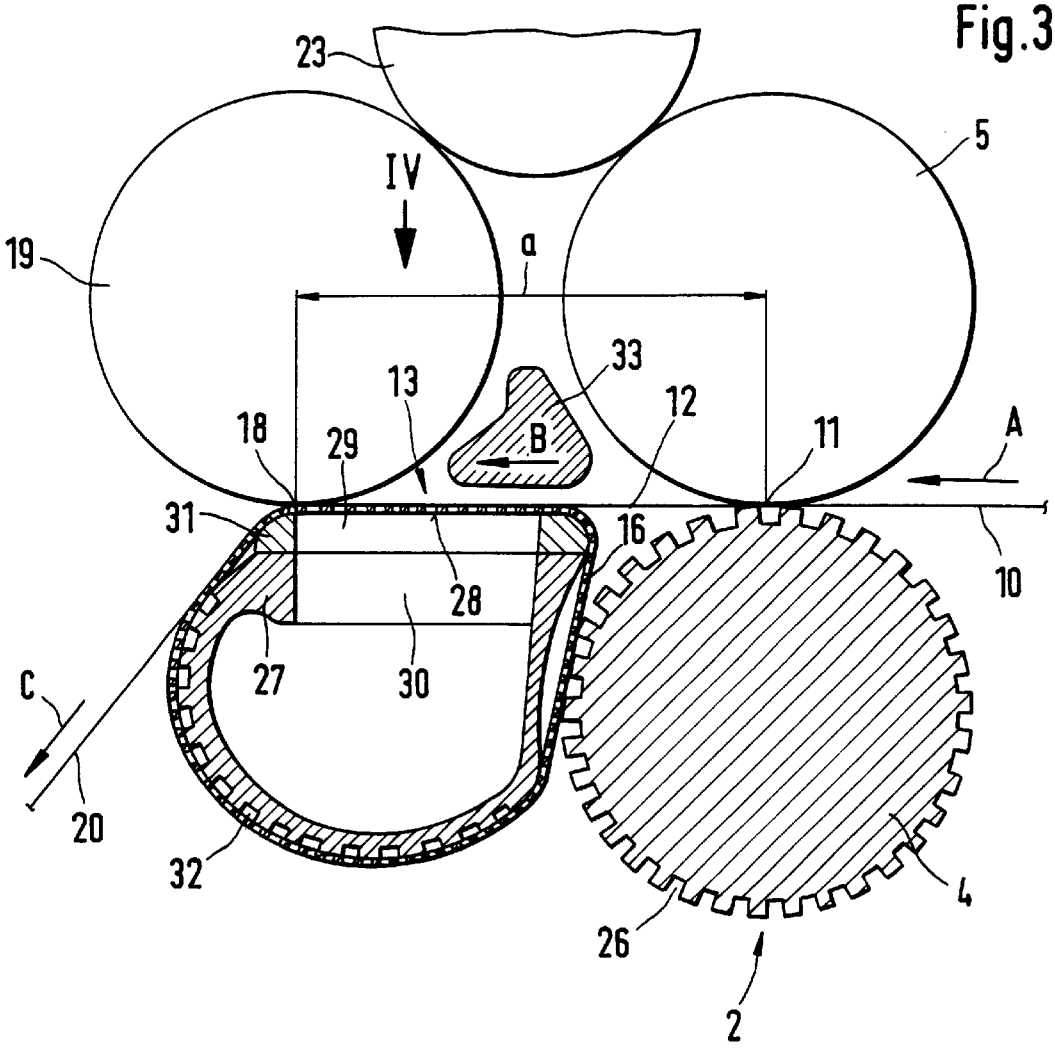
FIG. 3 is a view similar to FIG. 1 shown in another embodiment of the present invention.
Figure 4:
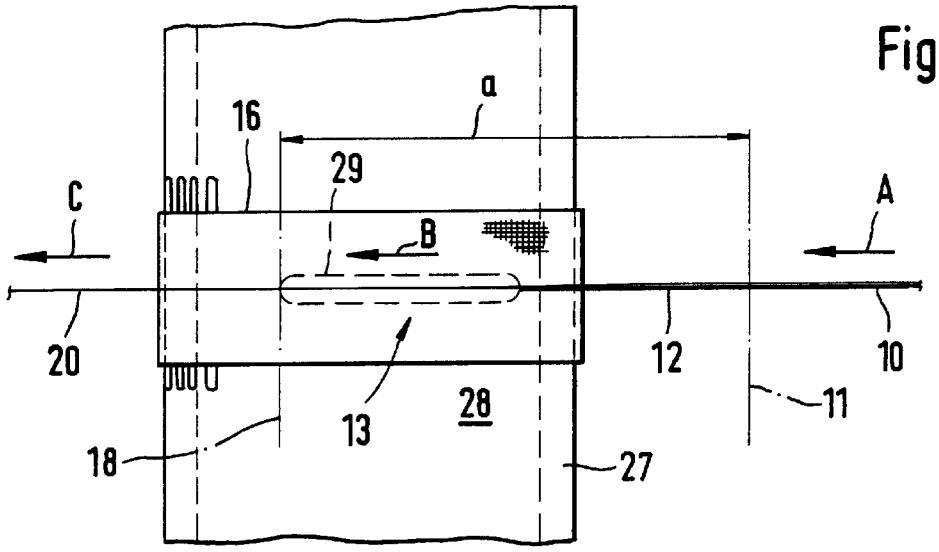
FIG. 4 is a view in the direction of the arrow IV of FIG. 3 onto the condensing zone.

In FIGS. 3 and 4, a further embodiment of the invention is shown in somewhat enlarged dimensions. Insofar as the same components as above are involved, the same reference numbers are used, so that a repeat description is omitted.

In the embodiment shown in FIGS. 3 and 4, a somewhat differently designed hollow section 27 is provided, which again extends over a plurality of spinning stations and which is connected by means of a suction opening with a vacuum source in a way not shown. The hollow section 27 faces the condensing zone 13 with a sliding surface 28, on which the perforated transport belt 16 again slides and which transports the fiber strand 12 through the condensing zone 13.

A suction slit 29 per spinning station is located in the sliding surface 28, which suction slit 29 in the present case extends exactly in the direction of motion B of the fiber strand 12, that is, it does not extend diagonally. This has been proved favorable in the case of some fiber materials, for example, long staple fiber material.

The opening 30 of the suction slit 29 is here also in the form of a chimney-like shaft, so that there is no tendency for fiber fly or the like to settle at this point. The chimney-like shaft graduates into a greatly enlarged cross section of the hollow section 27.

In this embodiment of the present invention, an exchangeable window 31 is also fitted onto the hollow section 27, which window surrounds the suction slit 29 on all sides. On the side of the transport belt 16 facing away from the window 31, the condensing zone 13 is shielded by a non-contact cover 33 between the pressure roller 5 and the nipping roller 19, so that a blower which travels along the ring spinning machine does not disturb the fiber strand 12 to be condensed.

On the side facing away from the condensing zone 13, the contour of the hollow section 27 is provided at the point where the transport belt 16 slides with longitudinal grooves 32 or with another type of diagonal knurling or fluting. In addition to the profiling 26 of the bottom roller 4 already described, which engages from below at the transport belt 16, the transport belt 16 can be freed of any adhering fiber fly from the inside.

Other advantages, features, and details of the invention will be found in the description below in which a number of embodiments of the invention are described in detail with reference to the drawings. The features referred to in the claims and the specification may be important to the invention individually or in any combination.

What is claimed is:

1. An apparatus for condensing a drafted fiber strand in a condensing zone arranged downstream of a front roller pair of a drafting unit, said apparatus comprising:

a stationary sliding surface, which has a suction slit extending essentially in the direction of the motion of the fiber strand, a perforated transport belt located between the fiber strand and the sliding surface, which transport belt transports the fiber strand over the sliding surface, the speed of said transport belt corresponding to at least the peripheral speed of the front roller pair, and a nipping roller bordering the condensing zone on an exit side thereof, wherein the distance between the nipping points defined on the one hand by the front roller pair and on the other hand by the nipping roller is no larger than the average staple length of the fibers located in the fiber strand.

2. An apparatus according to claim 1, wherein the distance between the nipping points measures between 20 to 27 mm.

3. An apparatus according to claim 2, wherein the suction slit aligned against the transport belt comprises a shaft-like opening.

4. An apparatus according to claim 3, wherein the shaft-like opening is formed by an exchangeable fitted window.

5. An apparatus according to claim 4, wherein the front roller pair comprises a bottom roller having a profiling on its periphery, which bottom roller is disposed outside of the condensing zone with a light pressure on the transport belt.

6. An apparatus according to claim 4, wherein the sliding surface is arranged on a suctioned hollow section which is looped by the transport belt and the hollow section is provided with longitudinal grooves which rub against the transport belt.

7. An apparatus according to claim 4, wherein the condensing zone is shielded by a non-contact cover facing the transport belt and suction slit.

8. An apparatus according to claim 3, wherein the front roller pair comprises a bottom roller having a profiling on its periphery, which bottom roller is disposed outside of the condensing zone with a light pressure on the transport belt.

9. An apparatus according to claim 3, wherein the sliding surface is arranged on a suctioned hollow section which is looped by the transport belt and the hollow section is provided with longitudinal grooves which rub against the transport belt.

10. An apparatus according to claim 3, wherein the condensing zone is shielded by a non-contact cover facing the transport belt and suction slit.

11. An apparatus according to claim 2, wherein the front roller pair comprises a bottom roller having a profiling on its periphery, which bottom roller is disposed outside of the condensing zone with a light pressure on the transport belt.

12. An apparatus according to claim 2, wherein the sliding surface is arranged on a suctioned hollow section which is looped by the transport belt and the hollow section is provided with longitudinal grooves which rub against the transport belt.

13. An apparatus according to claim 2, wherein the condensing zone is shielded by a non-contact cover facing the transport belt and suction slit.

14. An apparatus according to claim 1, wherein the suction slit aligned against the transport belt comprises a shaft-like opening.

15. An apparatus according to claim 14 wherein the shaft-like opening is formed by an exchangeable fitted window.

16. An apparatus according to claim 1, wherein the front roller pair comprises a bottom roller having a profiling on its periphery, which bottom roller is disposed outside of the condensing zone with a light pressure on the transport belt.

17. An apparatus according to claim 16, wherein the sliding surface is arranged on a suctioned hollow section which is looped by the transport belt and the hollow section is provided with longitudinal grooves which rub against the transport belt.

18. An apparatus according to claim 16, wherein the condensing zone is shielded by a non-contact cover facing the transport belt and suction slit.

19. An apparatus according to claim 1, wherein the sliding surface is arranged on a suctioned hollow section which is looped by the transport belt and the hollow section is provided with longitudinal grooves which rub against the transport belt.

20. An apparatus according to claim 19, wherein the condensing zone is shielded by a non-contact cover facing the transport belt and suction slit.

21. An apparatus according to claim 1, wherein the condensing zone is shielded by a non-contact cover facing the transport belt and suction slit.

22. An apparatus for condensing a drafted fiber strand in a condensing zone arranged downstream of a front roller pair of a drafting unit, said apparatus comprising:

a stationary sliding surface, which has a suction slit extending essentially in the direction of the motion of the fiber strand, a perforated transport belt located between the fiber strand and the sliding surface, which transport belt transports the fiber strand over the sliding surface, the speed of said transport belt corresponding to at least the peripheral speed of the front roller pair, and a nipping roller bordering the condensing zone on an exit side thereof, wherein the distance between the nipping points defined on the one hand by the front roller pair and on the other hand by the nipping roller is sufficiently small to assure nipping of a substantial portion of the fibers in the fiber strand during condensing in said condensing zone, and wherein an exchangeable fitted window bounds said suction slit at at least one side thereof.

23. An apparatus according to claim 22, wherein the suction slit comprises a shaft-like opening facing the transport belt, and wherein said exchangeable fitted window forms and surrounds at least an upper portion of the shaft-like opening.

24. An apparatus for condensing a drafted fiber strand in a condensing zone arranged downstream of a front roller pair of a drafting unit, said apparatus comprising:

a stationary sliding surface, which has a suction slit extending essentially in the direction of the motion of the fiber strand, a perforated transport belt located between the fiber strand and the sliding surface, which transport belt transports the fiber strand over the sliding surface, the speed of said transport belt corresponding to at least the peripheral speed of the front roller pair, and a nipping roller bordering the condensing zone on an exit side thereof, wherein the sliding surface is arranged on a suctioned hollow section which is looped by the transport belt and the hollow section is provided with longitudinal grooves which rub against the transport belt.

25. An apparatus according to claim 24, wherein the condensing zone is shielded by a non-contact cover facing the transport belt and suction slit.

26. An exchangeable fitted window for a condensing unit of a spinning machine which has a suction slit facing a perforated support surface for a fiber strand being condensed, said fitted window being configured to bound at least a portion of an area disposed adjacent said suction slit when in an in use position on said condensing unit.

27. An exchangeable fitted window according to claim 26, wherein said exchangeable fitted window forms a shaft-like opening facing said suction slit when in an in use position on said condensing unit.

28. A method for condensing a drafted fiber strand in a condensing zone arranged downstream of a front roller pair of a drafting unit, said method comprising:

transporting said drafted fiber strand over a stationary sliding surface which has a suction slit extending essentially in a direction of the motion of the fiber strand, said transporting including supporting the fiber strand on a perforated transport belt located between the fiber strand and the sliding surface, which transport belt transports the fiber strand over the sliding surface, the speed of said transport belt corresponding to at least the peripheral speed of the front roller pair, and nipping the fiber strand at a downstream end of the condensing zone with a nipping roller bordering the condensing zone on an exit side thereof, wherein the distance between the nipping points defined on the one hand by the front roller pair and on the other hand by the nipping roller is no larger than the average staple length of the fibers located in the fiber strand.

* * * * *